United States Patent [19]

Graham

[11] 4,185,924

[45] Jan. 29, 1980

[54] FLOWABLE MATERIAL PUMP APPARATUS

[75] Inventor: Douglas L. Graham, Auburn, Ind.

[73] Assignee: Solarcrete Corporation, Florence, Ky.

[21] Appl. No.: 937,555

[22] Filed: Aug. 28, 1978

[51] Int. Cl.[2] ..... B28C 5/06

[52] U.S. Cl. ..... 366/10; 366/13

[58] Field of Search ..... 366/10, 11, 3, 5, 8, 366/13; 222/193; 302/47

[56] References Cited

U.S. PATENT DOCUMENTS

| | | | |
|---|---|---|---|
| 3,017,164 | 1/1962 | Ayers | 366/13 |
| 3,091,438 | 5/1963 | Hembree | 366/10 |
| 3,484,082 | 12/1969 | DuPeuble | 366/10 |
| 3,938,786 | 2/1976 | Bernold | 366/13 |

*Primary Examiner*—Edward J. McCarthy
*Attorney, Agent, or Firm*—Lundy and Associates

[57] ABSTRACT

A flowable material pump apparatus for coupling to a vehicle including an application assembly comprising a frame which is attached to and travels in a spacially consistent fashion with respect to the vehicle. A flowable material supply and a flowable material propellant supply are attached to the frame and are in communication with the application assembly. The supplies are powered by a power system attached to the frame.

16 Claims, 3 Drawing Figures

FLOWABLE MATERIAL PUMP APPARATUS

BACKGROUND OF THE INVENTION

The invention relates to a pump apparatus, and in particular, to a flowable material pump apparatus coupled to a vehicle including an application assembly.

In the past, problems associated with pump apparatus coupled to vehicles have been of some concern. This is especially true in the area of movable application apparatus which require the flowable material to be pumped to an adjacent application assembly. One specific type of such movable apparatus would be the pumps designed to apply by the use of compressed air a coating of cementious material to an erected building structure.

The pump apparatus of the invention includes a sled that is detachably connected to a vehicle. The detachable connection allows the vehicle to be used for other purposes. However, due to the detachable connection, problems have existed relating to the ability of the sled to maintain a spacially consistent relationship with the vehicle during operation.

The typical operational area in which such pump apparatus operates is often times rough terrain generally difficult to negotiate. Problems have existed relating to the ability of the pump apparatus to negotiate such terrain. Further, problems have existed relating to the ability of the pump apparatus to remain operatively connected to the application apparatus when travelling over rough terrain.

Thus, it would be highly desirable to provide an improved flowable material pump apparatus which can be removably coupled to a vehicle.

It also would be highly desirable to provide an improved flowable material pump apparatus coupled to a vehicle including an application wherein the apparatus has the ability to maintain a spacially consistent relationship with the vehicle during operation.

It also would be highly desirable to provide an improved flowable material pump apparatus coupled to a vehicle including an application assembly wherein the apparatus has the ability to negotiate rough terrain.

Further, it would be highly desirable to provide an improved flowable material pump apparatus coupled to a vehicle including an application assembly wherein the apparatus has the ability to remain operationally connected to the application apparatus when travelling over rough terrain.

Finally, it would be highly desirable to provide an improved cementious material pump apparatus having both a source of cementious material and compressed air by which the cementious material can be applied as a coating to an erected building structure which can removably be coupled to a vehicle and negotiate difficult terrain and remain in an operational and spacially consistent relationship with the vehicle during operation.

SUMMARY OF THE INVENTION

It is an object of the invention to provide an improved flowable material pump apparatus for coupling to a vehicle including an application assembly.

It is also an object of the invention to provide an improved flowable material pump apparatus for coupling to a vehicle including an application assembly which has the ability to maintain a spacially consistent relationship with the vehicle during operation.

Further, it is an object of the invention to provide an improved flowable material pump apparatus for coupling to a vehicle including an application assembly which has the ability to negotiate rough terrain.

Still further, it is an object of the invention to provide an improved flowable material pump apparatus for coupling to a vehicle including an application assembly which has the ability to remain operationally connected to the application apparatus when travelling over rough terrain.

Finally, it is an object of the invention to provide an improved cementious material pump apparatus having both a source of cementious material and compressed air by which the cementious material can be applied as a coating to an erected building structure which can removably be coupled to a vehicle and negotiate difficult terrain and remain in an operational and spacially consistent relationship with the vehicle during operation.

The invention is a flowable material pump apparatus for coupling to a vehicle including an application assembly. The pump apparatus includes a frame. The frame is connected to the vehicle in a manner such that the frame maintains a spacially consistent relationship with the vehicle. A flowable material supply and a flowable material propellant supply are attached to the frame and are in communication with the application assembly. A power source is attached to the frame and operates the material and propellant supplies.

BRIEF DESCRIPTION OF THE DRAWINGS

The above mentioned and other features and objects of this invention and the manner of attaining them will become more apparent and the invention itself will be best understood by reference to the following description of the invention taken in conjunction with the accompanying drawings wherein.

DETAILED DESCRIPTION OF A SPECIFIC EMBODIMENT

Figure 1:
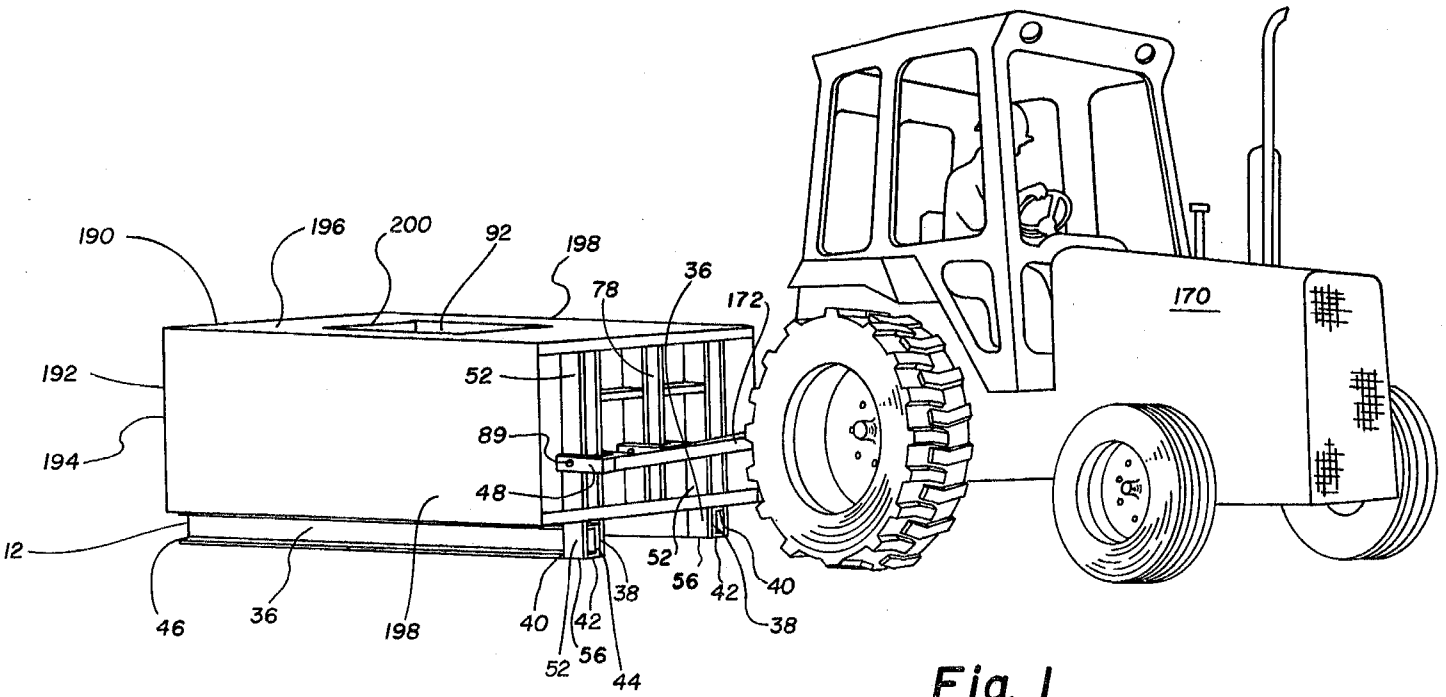
FIG. 1 is a perspective view of the apparatus of the invention connected to a vehicle.

Referring to the drawings, there is illustrated the pump apparatus 10 of the invention. The pump apparatus 10 of the invention comprises a sled 12, an auger assembly 14, an air compressor 16, and a power system 18.

The sled 12 includes a perimetal frame 20 having front 22 and rear 24 ends and opposite sides 26. A plurality of spaced-apart transverse slats 28 are provided with a web 30 and generally perpendicularly extending flanges 32. Flanges 32 have distal ends 34 which are secured to the perimetal frame 20. A pair of longitudinal runners 36 having a web 38 with generally perpendicularly extending top 40 and bottom 42 flanges and front 44 and rear 46 ends are attached at the top flanges 40 thereof to the bottom of the perimetal frame 20. The perimetal frame 20, transverse slats 38 and runners 36 together form a load-bearing structure.

A conventional three-point hitch 48 is secured to an upright frame assembly 50. Frame assembly 50 includes two connected pairs of spaced-apart side lift bars 52 having top 54 and bottom 56 ends and an aperture 58 therein. The front end 44 of each runner 36 is sandwiched between the paired side lift bars 52 at the bottom ends 56 thereof. The paired side lift bars 52 extend upwardly from the runners 36 and are connected at the top ends 54 thereof by a top channel member 60. The top channel member 60 has a web 62 and generally perpendicularly extending flanges 64 so that the paired side life bars 52 rest within the channel 66 formed by the web 62 and flanges 64. A lower channel member 68 includes a web 70, perpendicularly extending flanges 72, and opposite ends 74, 76. The lower channel member 68 is parallel and spaced-apart from the top channel member 60, and extends between and is attached to at the opposite ends 74, 76 thereof to the paired side lift bars 52. A pair of center lift members 78 have opposite ends 80, 82 and an aperture 84. The center lift members 78 vertically extend between and are attached at the opposite ends 80, 82 thereof to the top 60 and lower 68 channel members, respectively. Hitch 48 is connected by bolts 89 extending through apertures 58, 84, as shown.

The auger pump assembly 14 includes a hopper 90 which has an opening 92, front 94 and rear 96 walls, opposite side walls 98, and a floor 100. An exit opening 102 is contained in the front wall 94. An screw 104 has a shaft 106 having opposite ends 108, 110 and a threaded portion 112. The shaft 106 is journaled at the opposite ends 108, 110 thereof so as to extend longitudinal within the hopper 90 adjacent the floor 100 thereof. The screw 104 is in axial alignment with and extends through exit opening 102. The rearward most shaft end 110 extends rearwardly of the hopper 90.

A pipe 114 having opposite ends 116, 118 and supported by a pair of spaced-apart supports 120 is connected to the hopper 90 adjacent the exit opening 102. The pipe 114 communicates with the hopper 90 and end 108 of screw 104 is positioned therein. A hose 121 is connected to the one end 116 of the pipe 114, and provides communication with the application assembly.

The power system 18 includes a conventional gasoline engine 122 with a shaft 123 extending outwardly therefrom. A pulley 124 is attached to the distal end 125 of the shaft 123. A pair of pulleys 126, 127, connected by a shaft 128, are journaled in paired supports 129. The hydraulic pump 130 includes inlet 131 and outlet 132 ports as well as a pulley 133 designed to receive a belt. A first belt 134 connects the pulley 124 and the pulley 126, and a second belt 136 connects the pulley 127 and the pulley 133.

A hydraulic fluid reservoir 142 having inlet 144 and outlet 146 ports has the outlet port 146 thereof connected to the inlet port 131 of the hydraulic pump 130 by a conduit 148. A hydraulic valve 150 having inlet 152 and outlet 154 ports has the inlet port 152 thereof connected to the outlet port 132 of the hydraulic pump 130 by a conduit 156. A hydraulic motor 158 with inlet 160 and outlet 162 ports has the inlet port 160 thereof connected via conduit 164 to the hydraulic valve outlet port 154. The hydraulic motor outlet port 162 is connected to the hydraulic reservoir inlet port 144 via a conduit 166. This network of conduits 148, 156, 164, 166 completes the hydraulic connections of the power system 18.

The hydraulic motor 158 includes a shaft 167 which is operatively connected to the rearward end 110 of the auger shaft 106.

The apparatus 10 of the invention further includes an air compressor 16 secured to the sled 12. The air compressor 16 includes an output line 168 through which compressed air is pumped. The air compressor 16 is operatively connected to and powered by the engine 122.

Figure 2:
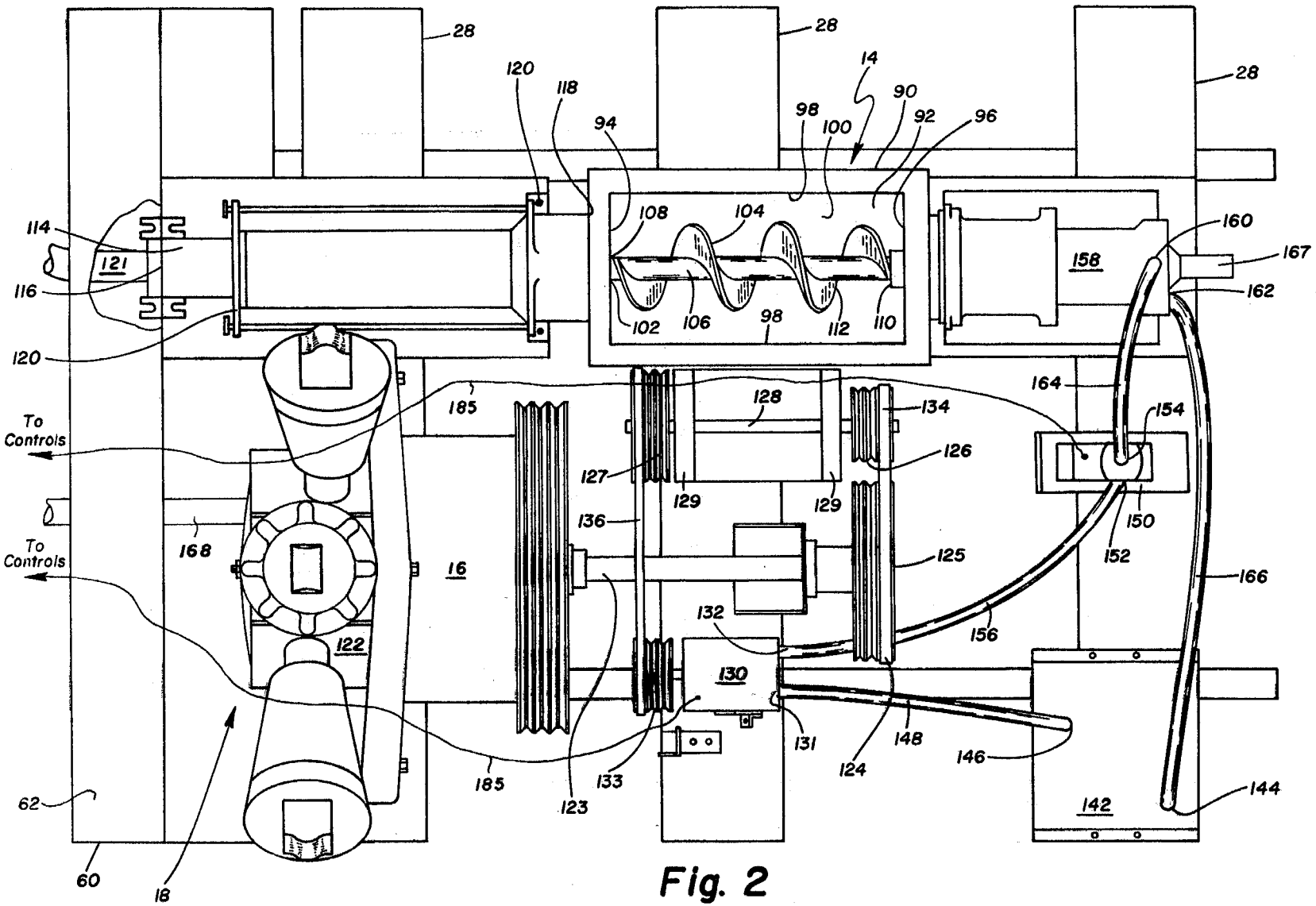
FIG. 2 is a top plan view of the apparatus of the invention having the housing removed.
Figure 3:
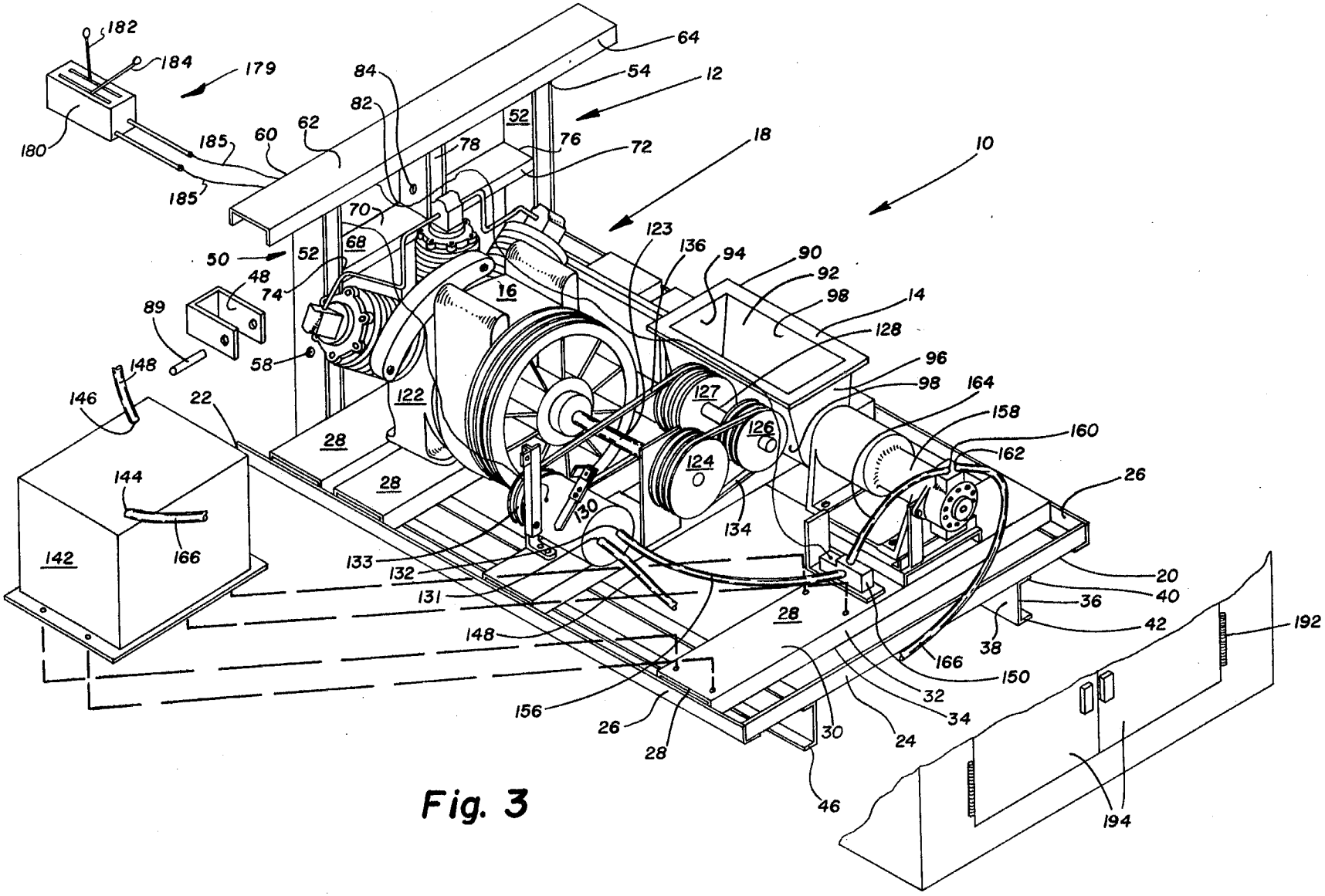
FIG. 3 is a perspective and exploded view of the apparatus of the invention having the housing removed and diagram actually illustrating the controls.

A desirable feature of the specific embodiment 10 illustrated in the drawings, is the compact nature of the apparatus. Referring to FIGS. 2 and 3, the engine 122 is shown to be adjacent the front of the sled 12. Air compressor 16 is coupled to the engine 122 and powered by the shaft 123 of the engine 122. Delivery pipe 114 of the hopper 90 is mounted in side by side relation with the engine 122. Rearwardly of the engine 122 is located the hydraulic fluid pump 130. In side by side relationship with the hydraulic pump 130 is the hopper 90. Rearwardly of the hydraulic pump 130 and the hopper 90 are located respectively the hydraulic reservoir 142, the hydraulic valve 150, and the hydraulic motor 158. By this compact arrangement, all of the aforementioned equipment is assembled on sled 12 so as to provide a self-powered pump apparatus having a cementious material supply and a compressed air supply in a relatively compact nature.

A pump housing 190 encloses the entire apparatus 10. The pump housing 190 includes a rear wall 192, a pair of rear doors 194, a top surface 196, and a pair of opposite side walls 198. Access is guided to the hopper 90 from the outside through a hopper access opening 200. Further, access to the interior at the pump housing 190 can be gained through the pair of rear doors 194.

In operation, the sled 12 is detachably connected to the vehicle 170. In particular, the sled 12 is connected by the three point hitch and frame assembly 50 thereof to the vehicle 170.

As the vehicle 170 travels, the sled 12 moves therebehind maintaining a spacially consistent relationship with respect to the vehicle 170. The action of the tongue 172 and the three point hitch 48 and frame assembly 50 and the runners 36 allows the sled 12 and the vehicle 170 to negotiate rough terrain maintaining a spacially consistent relationship between one another.

The vehicle 170 includes a control means 179 which controls the operation of the hydraulics of the apparatus of the invention. The control means 179 includes a set of controls 180 remotely located so as to be operable by the vehicle operator. The set of controls 180 includes control sticks 182, 184 operatively connected by connectors 185 to control the hydraulic valve 150 and the hydraulic pump 130, respectively. The set of controls 180 allows the vehicle operator to control the speed of rotation of the screw 104 which, in turn, controls the volume of flowable material forced out of the hopper 90 and eventually into the application apparatus.

The operation of the gasoline engine 122 operates the air compressor 16 which delivers compressed air through the output line 168. Both the output of the air compressor 16 and the output of the auger pump assembly 14 meet at the application apparatus to provide both cementious material and compressed air to apply the same.

As previously discussed, when the vehicle 170 travels over difficult terrain, the sled 12 maintains a spacially consistent relationship with the vehicle 170.

The maintenance of the spacially consistent relationship between the sled 12 and vehicle 170 is necessary to keep the operational connections between the pump apparatus 10 and the application assembly intact. By keeping these operational connections intact, many of the problems related to prior art apparatus are eliminated.

It is seen that applicant's invention provides an improved pump apparatus connected to a vehicle 170 having an application assembly attached thereto. The pump apparatus 10 includes a sled having a structure whereby the sled 12 maintains a spacially consistent relationship with the vehicle 70. Because the sled 12 and the vehicle 170 maintain a spacially consistent relationship, the operational connections between the application assembly 14 and the pump apparatus 10 remain intact during operation and the sled 12 and vehicle 170 have the ability to negotiate rough terrain. Finally, applicant's invention provides an improved cementious material pump apparatus which includes a self-contained, energy sufficient source of cementious material and compressed air in a relatively compact form having all of the advantages above-mentioned.

While there have been described above the principles of this invention in connection with specific apparatus, it is to be clearly understood that this description is made only by way of example and not as a limitation to the scope of the invention.

What is claimed is:

1. A flowable material pump apparatus for coupling to an application assembly and vehicle comprising a frame, means attached to said frame for coupling said frame to said vehicle and for causing said frame to travel in a spacially consistent fashion with respect to said vehicle, means on said frame for supplying to said application assembly said flowable material, means on said frame for supplying to said application assembly a flowable material propellant, and means on said frame for powering said supply means.

2. The apparatus of claim 1 wherein said frame is a sled having top and bottom surfaces and front and rear ends, said sled having a pair of elongated runners secured to the bottom thereof and extending from adjacent said front to adjacent said rear ends, said runners being generally parallel to each other.

3. The apparatus of claim 1 wherein said coupling means includes a hitch assembly, said hitch assembly including a hitch frame secured to said front end of said frame and a hitch secured to said hitch frame.

4. The apparatus of claim 1 wherein said flowable material supply means includes a hopper secured to said frame and a pump operatively connected to said hopper, said pump being operatively connected to and being powered by said powering means.

5. The apparatus of claim 1 wherein said propellant supply means includes an air compressor, said air compressor being operatively connected to and driven by said powering means.

6. The apparatus of claim 1 wherein said flowable material supply means includes a pump, said pump being operatively connected to and driven by said powering means.

7. The apparatus of claim 6 wherein said flowable material supply means includes a hopper, said hopper being secured to said frame, an auger assembly, said auger assembly being mounted in the lower portion of said hopper.

8. The apparatus of claim 7 wherein said hopper is elongated and has an open top and opposite front and rear vertical walls, said auger being mounted longitudinally of said hopper, said hopper having an exit opening in the front wall thereof, an exit pipe secured to said front wall, said exit opening providing access from within said hopper to said exit pipe, said auger being partially positioned within said exit pipe.

9. The apparatus of claim 8 further comprising a hose having opposite ends, one of said hose ends being connected to said exit pipe, the other of said hose ends being connected to said application assembly.

10. The apparatus of claim 1 wherein said powering means includes an engine and a hydraulic pump and fluid reservoir and valve and motor assembly, said engine being operatively connected to said hydraulic pump, said hydraulic pump being fluidly connected to said fluid reservoir and said valve, said hydraulic motor being fluidly connected to said valve and said fluid reservoir.

11. The apparatus of claim 10 wherein said propellant supply means includes an air compressor, said air compressor being operatively connected to said engine, said air compressor being in communication with said application assembly.

12. The apparatus of claim 11 including means for controlling the operation of said hydraulic assembly, said control means including a hydraulic pump control member and a hydraulic valve control member, said hydraulic pump and valve control members being positioned in said vehicle operatively connected to said hydraulic pump and hydraulic valve, respectively.

13. The apparatus of claim 1 wherein said flowable material supply means includes a pump, said pump being operatively connected to and driven by said powering means, said flowable material supply means includes a hopper, said hopper being secured to said frame, an auger assembly, said auger assembly being mounted in the lower portion of said hopper, said hopper is elongated and has an open top and opposite front and rear vertical walls, said auger being mounted longitudinally of said hopper, said hopper having an exit opening in the front wall thereof, an exit pipe secured to said front wall, said exit opening providing access from within said hopper to said exit pipe, said auger being partially positioned within said exit pipe, a hose having opposite ends, one of said hose ends being connected to said exit pipe, the other of said hose ends being connected to said application assembly, said powering means includes an engine and a hydraulic pump and fluid reservoir and valve and motor assembly, said engine being operatively connected to said hydraulic pump, said hydraulic pump being fluidly connected to said fluid reservoir and said valve, said hydraulic motor being fluidly connected to said valve and said fluid reservoir, said propellant supply means includes an air compressor, said air compressor being operatively connected to said engine, said air compressor being in communication with said application assembly, said engine and said hopper and auger being secured to said frame adjacent to one end thereof in side by side relation, said air compressor being secured to said frame immediately behind said engine, said hydraulic motor being secured to said frame immediately behind said hopper, said hydraulic pump and fluid reservoir being secured to said frame immediately behind said air compressor.

14. A cementious material spray apparatus comprising a vehicle capable of traversing rough terrain, an application assembly, an elongated frame, a hitch having opposite ends, one of said hitch ends being secured to one of said frame ends, the other of said hitch ends being secured to said vehicle, a pair of runners, said runners being secured to said frame, said runners extending longitudinally of said frame and being spaced-apart and generally parallel to each other, means for supplying cementious material under pressure to said application assembly, and means for supplying to said application assembly a propellant whereby said apparatus is a portable self-contained cementious material spray apparatus capable of traversing rough terrain.

15. A flowable material pump apparatus for coupling to an application assembly and vehicle comprising a frame, a hitch assembly, said frame being connected to and maintained in a spacially consistent fashion with respect to said vehicle by said hitch assembly, a pump secured to said frame, a hopper secured to said frame and operatively connected to said pump, a hose coupling connected to said hopper, an air compressor secured to said frame, an air line coupling connected to said air compressor, and a motor secured to said frame and operatively connected to said pump and said air compressor.

16. A cementious material spray apparatus comprising a vehicle capable of traversing rough terrain, an application assembly, an elongated frame, a hitch having opposite ends, one of said hitch ends being secured to one of said frame ends, the other of said hitch ends being secured to said vehicle, a pair of runners, said runners being secured to said frame, said runners extending longitudinally of said frame and being spaced-apart and generally parallel to each other, a power assembly and a pump and a hopper secured to said frame, said pump operatively connected to said hopper, a hose extending between said hopper and said application assembly, said pump being operatively connected to and being powered by said power assembly, an air compressor secured to said frame, an air line extending between said air compressor and said application assembly, said air compressor being operatively connected to and powered by said power assembly, whereby said apparatus is a portable self-contained cementious material spray apparatus capable of traversing rough terrain.

* * * * *